US006064296A

United States Patent [19]

Clancy et al.

[11] Patent Number: 6,064,296

[45] Date of Patent: May 16, 2000

[54] APPARATUS FOR THE SURVEILLANCE OF AN ELECTRONIC SECURITY ELEMENT IN AN INTERROGATION ZONE

[75] Inventors: Terry Clancy, Bensheim-Zell, Germany; David Stocks, Royston, United Kingdom

[73] Assignee: Esselte Meto International GmbH, Heppenheim, Germany

[21] Appl. No.: 08/940,025

[22] Filed: Sep. 29, 1997

[30] Foreign Application Priority Data

Oct. 18, 1996 [DE] Germany ..... 196 42 985

[51] Int. Cl.[7] ..... G08B 13/187

[52] U.S. Cl. ..... 340/10.1; 340/572.3; 340/572.4; 340/551; 235/380

[58] Field of Search ..... 340/825.54, 572.4, 340/572.3, 551, 10.1; 235/380

[56] References Cited

U.S. PATENT DOCUMENTS

| | | | |
|---|---|---|---|
| 4,168,496 | 9/1979 | Lichblau | 340/572 |
| 4,531,117 | 7/1985 | Nourse et al. | 340/572 |
| 4,663,612 | 5/1987 | Mejia et al. | 340/572 |
| 4,668,942 | 5/1987 | Eccleston et al. | 340/572 |
| 5,349,339 | 9/1994 | Kind | 340/572.4 |
| 5,557,085 | 9/1996 | Tyren et al. | 235/380 |

FOREIGN PATENT DOCUMENTS

| | | |
|---|---|---|
| 0 565 481 A1 | 10/1993 | European Pat. Off. . |
| 0707296A1 | 4/1996 | European Pat. Off. . |
| 2843293C2 | 12/1985 | Germany . |
| 3505052C2 | 11/1990 | Germany . |

OTHER PUBLICATIONS

Kammeyer, Karl Dirk: Nachrichtenbertragung, B.G. Teubner, Stuttgart 1992, S. 24–27, 422–428.

Makarios, Amir H., Tozer, Timothy C.: False–Lock Performance Improvement in Costas Loops, In: IEEE Transactions on Communications,vol. COM–30, No. 10, Oct. 1982, S. 2285–2288.

Godard, Dominique N.: Passband Timing Recovery in an All–Digital Modem Receiver, In: IEEE Transactions on Communications, vol. COM–26, No. 5, May 1978, S. 517–523.

*Primary Examiner*—Michael Horabik
*Assistant Examiner*—Yves Dalencourt
*Attorney, Agent, or Firm*—Jones, Tullar & Cooper, P.C.

[57] ABSTRACT

The present invention is directed to an apparatus for the surveillance of an electronic security element in an interrogation zone. The apparatus includes a transmitting device emitting at least one periodic interrogation signal into the interrogation zone, with the interrogation signal causing the security element to deliver a characteristic signal, a receiving device receiving the characteristic signal, and a computing/control unit evaluating the signals r(s) received from the receiving device and producing an alarm when the presence of the security element is established. The apparatus improves the detection of articles equipped with electronically detectable security elements within an interrogation zone, in that the computing/control unit evaluates the received signal with respect to amplitude and phase (I component and Q component), that it detects and determines by approximation an interference signal (fd(s)) occurring in the received signal, and then it removes the interference signal (fd(s)) from the received signal (r(s)).

14 Claims, 3 Drawing Sheets

APPARATUS FOR THE SURVEILLANCE OF AN ELECTRONIC SECURITY ELEMENT IN AN INTERROGATION ZONE

FIELD OF THE INVENTION

This invention relates to an apparatus for the surveillance of an electronic security element in an interrogation zone. The apparatus includes a transmitting device emitting at least one periodic interrogation signal into the interrogation zone, with the interrogation signal causing the security element to deliver a characteristic signal, a receiving device receiving the characteristic signal, and a computing/control unit evaluating the signals received from the receive device and producing an alarm when the presence of the security element is established.

BACKGROUND OF THE INVENTION

From prior German Patent, DE 44 36 977.8 there is known an apparatus for the electronic surveillance of articles protected by resonant circuits. To increase the sensitivity relative to interference while on the other hand obtaining a high detection rate, both the amplitudes of the received signals and the phase differences between the transmitter field and the received signals are evaluated. The resonant frequency of the security elements varies on account of manufacturing tolerances. In order to ensure that all security elements are detected within predetermined tolerances, the transmitting device cyclically emits into the interrogation zone an interrogation signal of a bandwidth tuned to the tolerances specified in the manufacture of the security elements. The comparison values used are predetermined threshold values or previously stored curve patterns. From this the disadvantage of this prior known apparatus results: The actual sources of interference acting on the received signals in or in the vicinity of the interrogation zone are not considered or only insufficiently considered.

To detect the presence of electromagnetic security elements in an interrogation zone, it is proposed in European Patent EP 123 586 B to emit into the interrogation zone, in addition to two interrogation fields with the frequencies F1 and F2 in the kilohertz range, a field with a frequency F3 in the hertz range. The two interrogation fields with frequencies F1 and F2 cause a security element present in the interrogation zone to emit a characteristic signal with the intermodulation frequencies $n \cdot \mathbf{F1} \pm m \cdot \mathbf{F2}$ (where n, m=0, 1, 2, . . . ). The low-frequency interrogation field causes the security element to be driven from saturation in one direction into saturation in the other direction at the clock rate of this particular field. As a result, the characteristic signal occurs periodically at the frequency of the low-frequency field.

As an alternative solution, it has further become known to use only one interrogation field in the kilohertz range for excitation of the security element, with the characteristic signal of the security element occurring again at the clock rate of a low-frequency field cycling the magnetically soft, non-linear material between the two states of saturation.

SUMMARY OF THE INVENTION

It is an object of the present invention to provide an apparatus which improves the detection of articles equipped with electronically detectable security elements within an interrogation zone. This object is accomplished in that a computing/control unit evaluates a received signal with respect to amplitude and phase (I component and Q component), that it detects and determines by approximation an interference signal occurring in the received signal, and in that it removes the interference signal from the received signal.

In an advantageous further aspect of the apparatus of the present invention, it is proposed that the computing/control unit resolve the received signal r(s) into the following partial signals: a base signal b(s), a direct signal d*(s), the response signal of the security element t*(s), and a noise signal n(s) where s=1, 2, 3, . . . n identifies the respective measured value.

In cases where a system monitoring RF security elements is used, the base signal b(s) corresponds to the signal indicated by the analog-to-digital converters (ADC) when the transmit device is deactivated and no external noise sources are present. Therefore, the base signal b(s) corresponds to the signal originating from the electronic equipment of the receiving device.

With the transmitting device activated, a small portion of the transmitted signal is directly received by the receiving device. This signal portion corresponds to the direct signal d(s). The direct signal varies in both amplitude and phase when, for example, a person is present in the vicinity of the receiving device. As soon as a security element passes through the interrogation zone, it will produce a characteristic signal proportional to the transmitted signal. This signal is, in consequence, also proportional to the direct signal d(s). External noise signals received from the receiving device are reflected in the signal portion n(s).

In view of the foregoing, the apparatus has proven to be particularly advantageous for the surveillance of resonant frequency (RF) security elements to equate the direct signal $d^*(s)$ with $k \cdot e^{i\Theta} \cdot d(s)$, and to equate the response signal $t^*(s)$ of the security element with $k \cdot e^{i\Theta} \cdot d(s) \cdot t(s)$. In this equation, k denotes the amplitude variation, and $\Theta$ the phase variation of the direct signal d(s).

In cases where an apparatus for the surveillance of electromagnetic (EM) security elements is used, an advantageous further aspect of the apparatus of the present invention provides for equating the direct signal $d^*(s)$ with $k \cdot e^{i\Theta} \cdot d(s)$, and the response signal $t^*(s)$ of the security element with t(s), where k denotes again the amplitude variation, and $\Theta$ the phase variation of the direct signal d(s).

In the following, reference is made to the surveillance system with the three frequencies F1, F2 and F3 as described in the preamble hereof. In an electromagnetic surveillance system, each non-linear material produces in the interrogation zone electromagnetic signals with the frequency F1+F2 or its harmonics, accordingly including also shopping carts or metal packaging materials.

In order to protect the transmitting/receiving devices from such interference relative to the outside, metal plates are frequently provided on the side facing away from the interrogation zone. If the interference were static, it would be sufficient to deduct invariably a constant value from the received signal. However, this is rarely the case: Interference varies, for example, as a result of fluctuations in the energy supply—causing amplitude variations—, in the frequencies F1, F2, F3 used in the system—causing phase variations—, or in a mechanical movement—causing amplitude and phase variations. Because the amplitudes of these interference signals are up to twenty times higher than the characteristic signals of security elements, already minor fluctuations have an aggravating effect on the detection rate of security elements if a simple subtraction algorithm is used. It is therefore of eminent importance to be able to balance amplitude and phase variations of the direct signal as disclosed in the present.

It has proven to be particularly advantageous that the computing/control unit determines the direct signal d(s) from the difference of the long-term averages of received signals r(s) and base signals b(s). This enables the measuring accuracy of the apparatus to be increased.

In an advantageous further aspect of the apparatus of the present invention, the computing/control unit performs the following approximation: The direct signal d(s) is rotated in the IQ plane in such a manner that its main component coincides with the direction of the I component, with rd(s) denoting the direct signal upon rotation (=rotated direct signal).

In particular, the rotation is simulated by multiplying d(s) by the complex number $$\frac{\text{Re_Energy} - j \cdot \text{Im_Energy}}{\sqrt{\text{Re_Energy}^2 + \text{Im_Energy}^2}},$$

where Re_Energy identifies the energy of the real part, and Im_Energy the energy of the imaginary part of the direct signal d(s).

According to an advantageous feature, the computing/control unit subtracts from the rotated direct signal rd(s) a portion, if any, of the imaginary part of the rotated direct signal, thereby obtaining the amended direct signal $$ard(s)=rd(s)-Im(rd(s))\cdot corr(Im(rd(s)),Re(rd(s))),$$

where $$corr(\text{Im}(rd(s)), \text{Re}(rd(s))) = \frac{\sum \text{Im}(rd(s)) \cdot \text{Re}(rd(s))}{\sum \text{Im}(r(d(s))^2}$$

denotes the portion of the imaginary part of the rotated direct signal Im(rd(s)) in the real part of the rotated direct signal Re(rd(s)).

According to an advantageous further aspect of the apparatus of the present invention, the computing/control unit correlates the amended direct signal ard(s) with the received signal r(s), the correlations advantageously reading as follows:

rc=corr(Re(ard(s)),Re(r(s)−b(s)))—in this correlation, the portion of the amended direct signal ard(s) is determined in the I component of the received signal r(s)—, and ic=corr (Re(ard(s)),Im(r(s)−b(s)))—in this correlation, the portion of the amended signal ard(s) is determined in the Q component of the received signal r(s).

In an advantageous configuration of the apparatus of the present invention, the rotated direct signal rd(s) is subsequently multiplied by the complex number rc−j·ic., yielding the final direct signal fd(s):

$$fd(s)=rd(s)\cdot(rc-j\cdot ic)$$

The computing/control unit then subtracts the computed (simulated) value for fd(s) from the received signal r(s).

BRIEF DESCRIPTION OF THE DRAWINGS

The present invention will be described in more detail in the following with reference to the accompanying drawings. In the drawings.

DESCRIPTION OF THE PREFERRED EMBODIMENT

Figure 1:
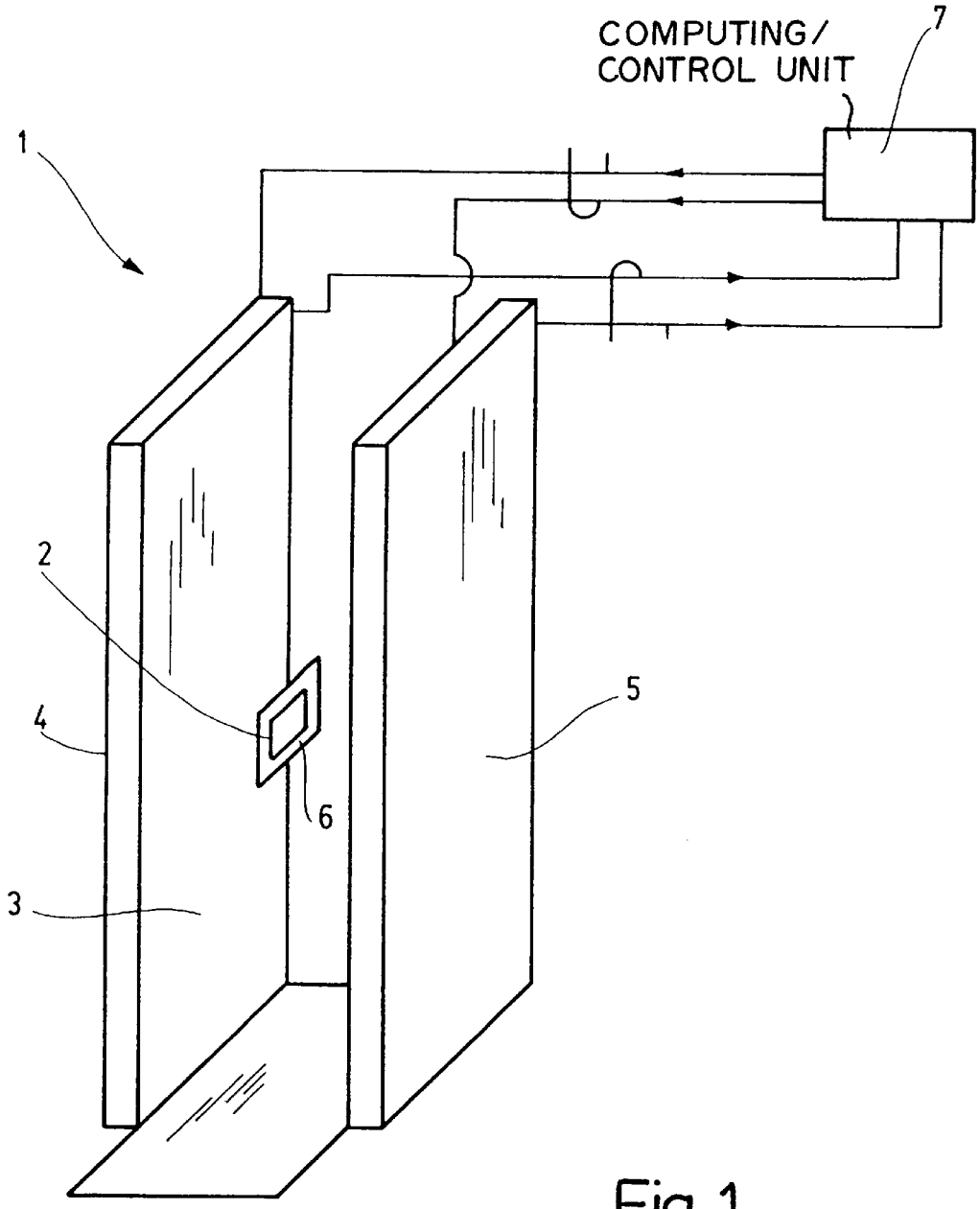
FIG. 1 is a schematic illustration of a surveillance zone for electronically protected articles.

Referring now to FIG. 1, there is shown schematically the apparatus 1 of the present invention for detecting the presence of an article 6 provided with a security element 2 in an interrogation zone 3. The interrogation zone 3 is defined by two antennas, preferably disposed in parallel arrangement and accommodating the transmitting device 4 and the receive device 5. It will be understood, of course, that both devices 4, 5 may also be accommodated in one antenna. Control of the surveillance apparatus 1 and evaluation of the measured values are by means of the computing/control unit 7.

Figure 2:
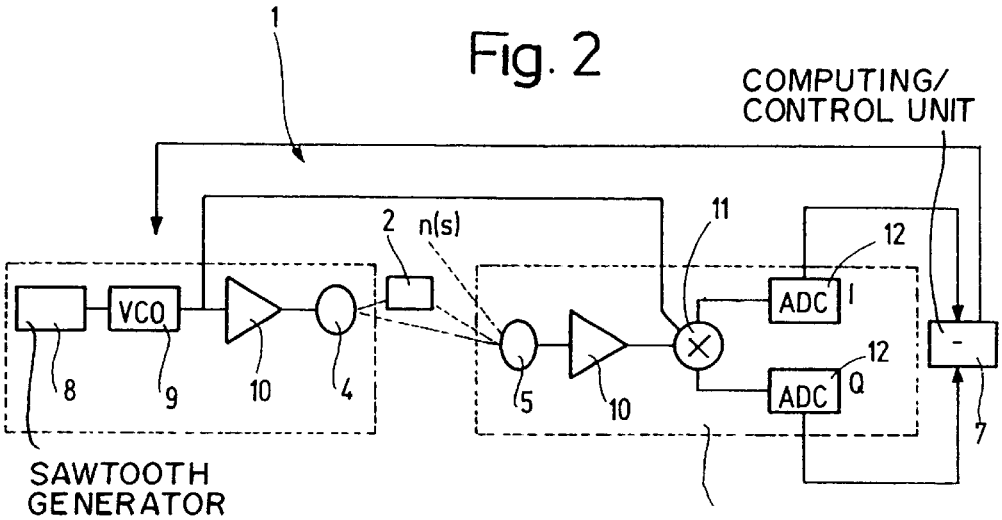
FIG. 2 is a block diagram of a surveillance apparatus for RF security elements.

FIG. 2 shows a block diagram of a surveillance apparatus 1 for RF security elements 2. The transmitting device 4 emits cyclically sensing signals of a predetermined bandwidth into the interrogation zone 3. The bandwidth is dimensioned in such a manner that the resonant frequencies of all of the resonant circuits utilized for article protection are reliably detected, regardless of manufacturing-related tolerances.

The receiving device 5 receives a signal r(s) containing, in addition to the characteristic signal t*(s), also a signal portion d(s) originating directly from the transmitting device 4, as well as external noise signals n(s). The receiving signals r(s) are amplified in amplifier 10 and demodulated in demodulator 11. Analog-to-digital converters 12 subsequently deliver to the computing/control unit 7 measured values for the I component which reflects the amplitude of a received signal r(s), and for the Q component which includes the phase information of the received signal r(s).

Figure 3:
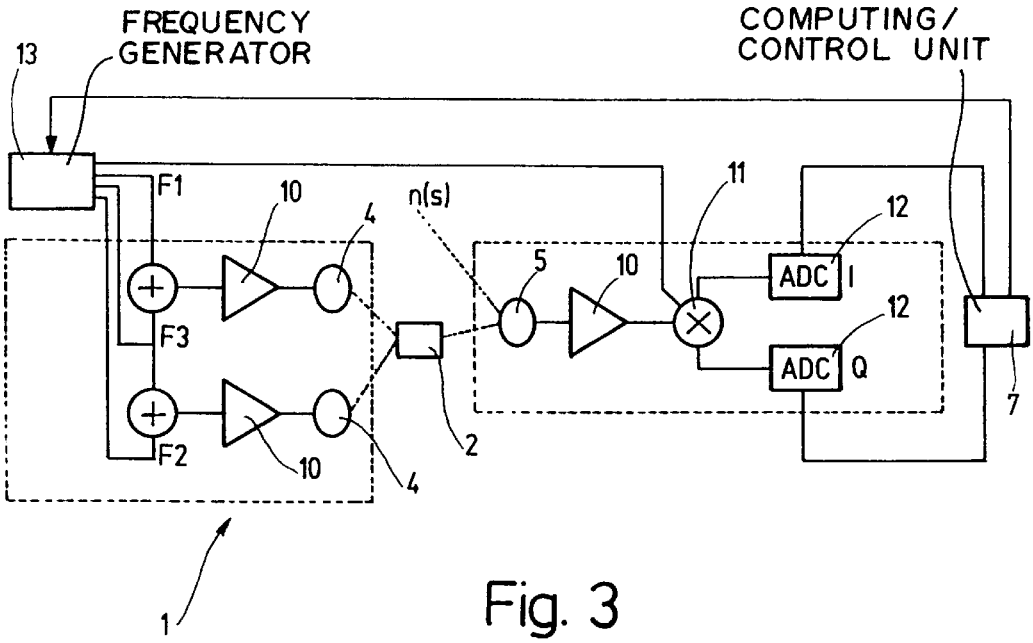
FIG. 3 is a block diagram of a surveillance apparatus for EM security elements.

FIG. 3 shows an analog block diagram of a surveillance apparatus 1 for electromagnetic security elements 2. The two transmitting antennas of the transmitting device 4 deliver signals with the frequencies F1, F2 and F3 into the interrogation zone 3. The interrogation signals cause the electromagnetic security element 2 essentially comprised of a metal having non-linear magnetic properties to emit characteristic signals t*(s) received by the receiving device 5. Aside from the characteristic signals t*(s) and the direct signals d(s), the received signals r(s) also contain external noise signals n(s). As in the event of the surveillance of RF security elements 2, the I and the Q component of the received signals r(s) are made available to the computing/control unit 7 for evaluation as disclosed in the present invention.

Figure 4:
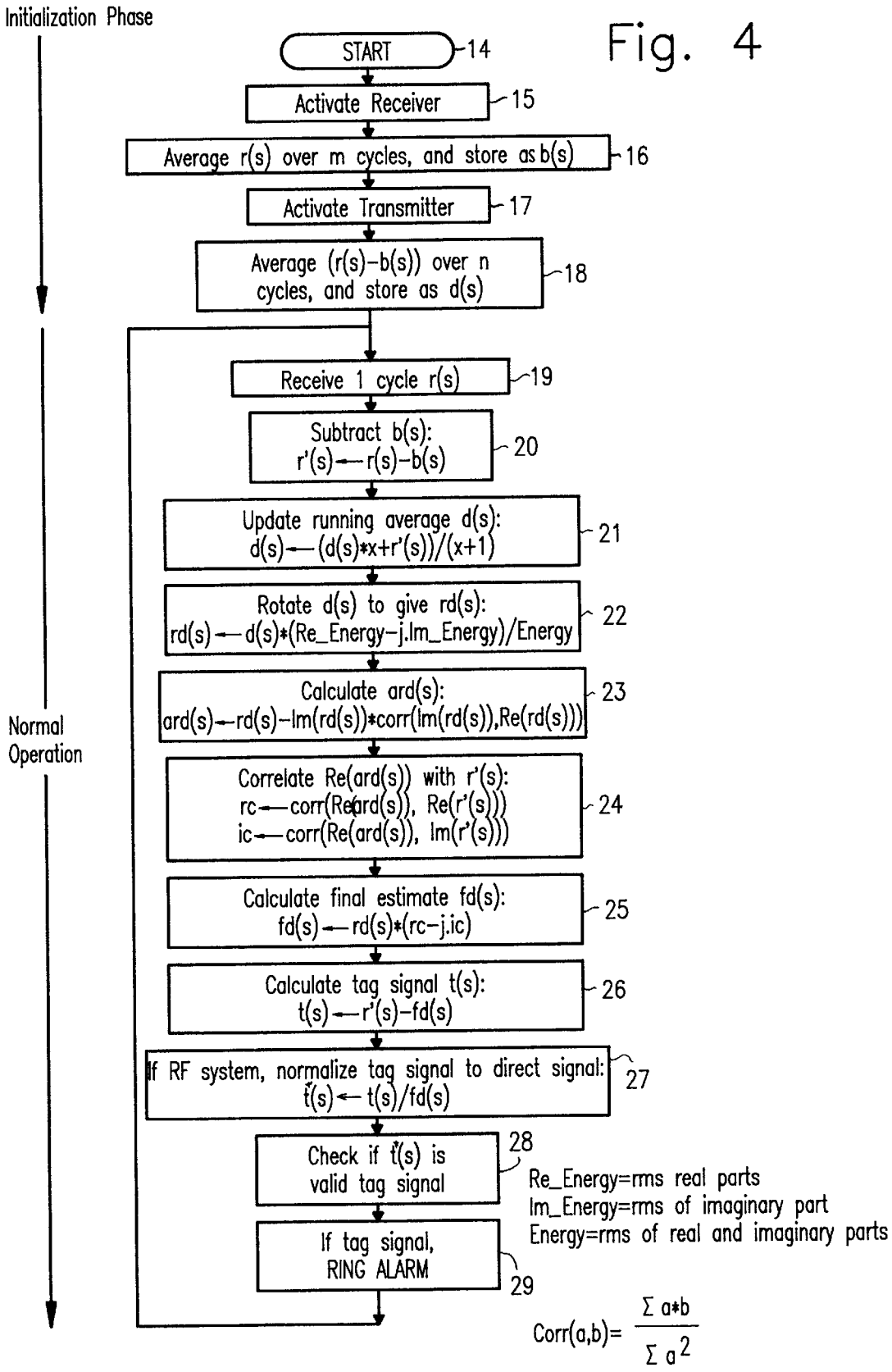
FIG. 4 is a flowchart of a control program for the computing/control unit finding preferred application.

FIG. 4 shows a flowchart of a control program which is particularly well suited for the evaluation of the received signals r(s) as disclosed in the present invention. Program levels 14 to 18 comprise what is referred to as an initialization program preceding the actual control program. This initialization program is preferably executed at a fixed time interval to ensure that updated initial values are at all times available to the apparatus 1 of the present invention. Following startup of the program at 14, the receiving device is activated at level 15. The received signals r(s) are averaged over m cycles, with the duration of each cycle corresponding to the duration of a periodic interrogation signal. The averaged value is stored as a base signal b(s). As defined in the foregoing, this base signal corresponds to the signal portion of the receiving device 5 with the transmitting device 4 deactivated.

The next step at program level 17 involves activation of the transmitting device 4. At level 18, the averaged base signal b(s) is subtracted from the received signal averaged over several cycles. The result of this computation is the direct signal d(s).

This initialization phase is followed by the actual control and surveillance program for the purpose of detecting the presence of security elements within the interrogation zone. At program level 19, the signals received during a cycle are recorded. Related to the surveillance systems of the prior art described in the preamble hereof, a cycle may be defined as follows: In cases where an RF system is employed, a cycle corresponds to the interval of time during which a frequency range of a predetermined bandwidth is emitted. Where an EM system is utilized, the cycle is determined by the low frequency F3. At 20, the base signal b(s) is then subtracted from the received signal r(s). The result of this subtraction operation is the corrected received signal r' (s).

At 21, the running average of the direct signal d(s) is updated. Updating is performed according to the following computation:

$$d(s) \leftarrow (d(s)^* \cdot x + r'(s))/(x+1),$$

where x=a constant, that sets the time constant of the filter.

At program level 22, the direct signal d(s) is rotated in such a manner that the maximum of the direct signal d(s) comes to lie in the direction of the I component. Preferably, the rotation is performed by multiplying the direct signal d(s)* by the complex number $$\frac{\text{Re_Energy} - j \cdot \text{Im_Energy}}{\sqrt{\text{Re_Energy}^2 + \text{Im_Energy}^2}},$$

where Re_Energy denotes the energy of the real part of d(s), and Im_Energy is the energy of the imaginary part of d(s). (Re_Energy$^2$+Im_Energy$^2$) corresponds to the total energy. The rotated direct signal rd(s) is the result of this rotation.

Following rotation, a correlation may exist between the real part Re(rd(s)) and the imaginary part Im(rd(s)) of the rotated direct signal rd(s). This remaining portion is subtracted from the rotated direct signal rd(s) at program level 23. The result of this subtraction operation is the amended rotated direct signal $$ard(s) \leftarrow rd(s) - Im(rd(s)) \cdot corr(Im(rd(s)), Re(rd(s))),$$

where $$corr(\text{Im}(rd(s)), \text{Re}(rd(s))) = \frac{\sum \text{Im}(rd(s)) \cdot \text{Re}(rd(s))}{\sum \text{Im}(r(d(s))^2}$$

denotes the portion of the imaginary part of the rotated direct signal Im(rd(s)) in the real part of the rotated direct signal Re(rd(s)). Expressed generally by the quantities a and b, the following equation applies:

$$corr(a,b) = (\Sigma a \cdot b)/(\Sigma a^2)$$

At 24, the amended rotated direct signal ard(s) is then correlated with the received signal r'(s). In particular, the I component and the Q component of the received signal r'(s)=r(s−b(s) are correlated with the I component of the amended rotated direct signal ard(s).

In this calculation, $$rc = corr(Re(ard(s)), Re(r'(s)))$$

is the portion of ard(s) contained in the I component of the received signal r(s)−b(s), and $$ic = \text{corr}(Re(ard(s)), Im(r'(s)))$$

is the portion of the amended signal ard(s) contained in the Q component of the received signal r(s)−b(s).

At 25, the rotated direct signal rd(s) is multiplied by the coefficients calculated at 24. The final direct signal fd(s) then results as follows:

$$fd(s) \leftarrow rd(s) \cdot (rc - j \cdot ic)$$

The characteristic signal of the security element 2 is calculated at program level 26 applying the following formula:

$$t(s) \leftarrow r'(s) - fd(s)$$

If the apparatus 1 of the present invention is a surveillance system for RF security elements, the characteristic signal t(s) of the security element is normalized at program level 27 to the final direct signal fd(s):

$$t(s) \leftarrow t(s)/fd(s)$$

Then it is checked at 28 whether the signal t(s) is a characteristic signal of a security element 2. If the answer is yes, an alarm will be produced at 29. Upon completion of the check at 29, the program will return to 19, starting the next monitoring cycle.

We claim:

1. An apparatus for the surveillance of an electronic security element in an interrogation zone, comprising:

a transmitting device which emits at least one periodic interrogation signal into the interrogation zone, said interrogation signal causing the security element to deliver a characteristic signal;

a receiving device for receiving said characteristic signal and generating a received signal (r(s)); and a computing/control unit which receives said received signal (r(s)) from said receiving device, evaluates said received signal (r(s)) and produces an alarm when the presence of a security element is established, said computing/control unit evaluates said received signal (r(s)) with respect to amplitude and phase (I component and Q component), determines, by approximation, an interference signal (fd(s)) occurring in said received signal (r(s)), and removes said interference signal (fd (s)) from said received signal (r(s)).

2. The apparatus as defined in claim 1, wherein said computing/control unit resolves said received signal (r(s)) into the following partial signals: a base signal b(s), a direct signal d*(s), a response signal of the security element t*(s), and a noise signal n(s), where s=1, 2, 3, . . . n.

3. The apparatus as defined in claim 2, wherein for resonant frequency (RF) security elements, said computing/control unit equates said direct signal d*(s) with $k \cdot e^j \Theta \cdot d(s)$, and said response signal t*(s) with $k \cdot e^j \Theta \cdot d(s) \cdot t$ (s), where k denotes the amplitude variation and Θ the phase variation of said direct signal d(s).

4. The apparatus as defined in claim 2, wherein for electromagnetic (EM) security elements, said computing/control unit equates said direct signal d*(s) with $k \cdot e^j \Theta \cdot d(s)$, and said response signal t*(s) with t(s), where k denotes the amplitude variation and Θ the phase variation of said direct signal d(s).

5. The apparatus as defined in claim 2, wherein said computing/control unit determines said direct signal d(s)

from the difference between the long-term averages of said received signals r(s) and said base signals b(s).

6. The apparatus as defined in claim 3, wherein said computing/control unit determines said direct signal d(s) from the difference between the long-term averages of said received signals r(s) and said base signals b(s).

7. The apparatus as defined in claim 4, wherein said computing/control unit determines said direct signal d(s) from the difference between the long-term averages of said received signals r(s) and said base signals b(s).

8. The apparatus as defined in claim 5, wherein said computing/control unit performs the following approximation: said direct signal d(s) is rotated in the IQ plane in such a manner that its main component coincides with the direction of the I component, with rd(s) denoting the direct signal upon rotation (=rotated direct signal).

9. The apparatus as defined in claim 8, wherein said rotation is simulated by multiplying said direct signal d(s) by the following complex number:

$$\frac{\text{Re_Energy} - j \cdot \text{Im_Energy}}{\sqrt{\text{Re_Energy}^2 + \text{Im_Energy}^2}},$$

where Re_Energy identifies the energy of the real part, and Im_Energy the energy of the imaginary part of said direct signal d(s).

10. The apparatus as defined in claim 9, wherein said computing/control unit subtracts a portion, if any, of said imaginary part of said rotated direct signal from said rotating direct signal rd(s) thereby obtaining the following amended direct signal:

$$ard(s)=rd(s)-Im(rd(s))\ \text{corr}\ (Im(rd(s)), Re(rd(s)),$$

where:

$$\text{Corr}(\text{Im}(rd(s)), \text{Re}(rd(s))) = \frac{\sum \text{Im}(rd(s)) \cdot \text{Re}(rd(s))}{\sum Im(r(d(s))^2}$$

denotes the portion of said imaginary part of said rotated direct signal Im(rd(s)) in the real part of said rotated direct signal Re(rd(s)).

11. The apparatus as defined in claim 10, wherein said computing/control unit correlates said amended direct signal ard(s) with said received signal r(s).

12. The apparatus as defined in claim 11, wherein said correlation reads as follows:

$$rc=\text{corr}(Re(ard(s)), Re(r(s)-b(s))),$$

whereby the portion of said amended direct signal ard(s) becomes determinable in the I component of said received signal r(s), and $$ic=\text{corr}(Re(ard(s))Im(r(s)-b(s)),$$

whereby the portion of said amended signal ard(s) becomes determinable in the Q component of said received signal r(s).

13. The apparatus as defined in claim 12, wherein said rotated direct signal rd(s) is multiplied by a complex number: rc=j·ic, yielding the final direct signal fd(s), where $$fd(s)=rd(s)\cdot(rc-j\cdot ic).$$

14. The apparatus as defined in claim 13, wherein said computing/control unit subtracts the computed value for fd(s) from said received signal r(s).

* * * * *